US010867471B1

(12) United States Patent
Gutierrez

(10) Patent No.: US 10,867,471 B1
(45) Date of Patent: Dec. 15, 2020

(54) APPARATUS TO PLAY A CASINO GAME

(71) Applicant: Manuel Guadalupe Gutierrez, Hawthorne, CA (US)

(72) Inventor: Manuel Guadalupe Gutierrez, Hawthorne, CA (US)

( * ) Notice: Subject to any disclaimer, the term of this patent is extended or adjusted under 35 U.S.C. 154(b) by 0 days.

(21) Appl. No.: 16/523,699

(22) Filed: Jul. 26, 2019

(51) Int. Cl.
*G07F 17/32* (2006.01)

(52) U.S. Cl.
CPC ..... *G07F 17/322* (2013.01); *G07F 17/3262* (2013.01)

(58) Field of Classification Search
None
See application file for complete search history.

(56) References Cited

U.S. PATENT DOCUMENTS 5,839,728 A 11/1998 Kao
6,565,088 B2 5/2003 Perrie et al.
7,080,838 B2 * 7/2006 Cohen ..... A63F 3/00157 273/146
7,694,969 B2 * 4/2010 Abrahamson ..... A63F 3/00157 273/247
9,914,045 B1 3/2018 Lambert et al.
2010/0252991 A1 * 10/2010 McGrath ..... A63F 9/04 273/146
2013/0084936 A1 * 4/2013 Pease ..... G07F 17/32 463/18
2018/0315276 A1 11/2018 Persson et al.

FOREIGN PATENT DOCUMENTS

CN 1652849 A 8/2005

* cited by examiner

*Primary Examiner* — Ronald Laneau

(57) ABSTRACT

Disclosed herein is an apparatus to play a casino game. Further, the apparatus may include a plurality of legs configured to support a table top, and a playing dice with six sides. Further, the table top may include a player section including at least one player station and a depression including a playing area. Further, the table top may include a dealer section comprising a dealer station. Further, the dealer section may include at least one score tracker comprising a plurality of markings depicting a plurality of possible scores attained by at least one player, and a dealer while playing the casino game. Further, the dealer section may include at least one player marker housing configured to store at least one player marker, and a dealer chip housing configured to store a plurality of casino chips of at least one denomination.

20 Claims, 4 Drawing Sheets

APPARATUS TO PLAY A CASINO GAME

TECHNICAL FIELD

Generally, the present disclosure relates to the field of gaming apparatuses. More specifically, the present disclosure relates to an apparatus to play a casino game.

BACKGROUND

Casino games are very popular, with the number of individuals visiting casinos increasing. Cities like Las Vegas, Atlantic City, and Monte Carlo see millions of tourists every year visiting their casinos.

Individuals are able to play multiple games, including card based games, Roulette, games on electronic slot machines, and so on in gaming establishments. Further, individuals may also partake in casino gaming through online gaming, However, most traditional casino games comprise rules that have remained largely unchanged since the games have been created. Individuals wish to partake in newer games that are more exciting to play, with good odds of payment.

Therefore, there is a need for an improved apparatus to play a casino game that may overcome one or more of the above-mentioned problems and/or limitations.

BRIEF SUMMARY

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is an apparatus to play a casino game. Further, the apparatus may a plurality of legs configured to support a table top. Further, the table top may include a player section including at least one player station and a depression may include a playing area. Further, at least one player may be positioned at the at least one player station while playing the casino game. Further, the casino game may be played on the playing area by the at least one player and a dealer representing a facility. Further, the table top may include a dealer section comprising a dealer station. Further, the dealer may be positioned at the dealer station while playing the casino game. Further, the dealer section may include at least one score tracker comprising a plurality of markings depicting a plurality of possible scores attained by the at least one player, and the dealer while playing the casino game. Further, the dealer section may include at least one player marker housing configured to store at least one player marker while the casino game may be not be played. Further, the dealer section may include a dealer chip housing configured to store a plurality of casino chips of at least one denomination. Further, the plurality of casino chips may be used by the dealer to pay-off the at least one player based at least one pay-off rule of the casino game. Further, the apparatus may include a playing dice with six sides. Further, each of the 6 sides may include an indicia dispose thereupon. Further, two opposite sides of the playing dice comprise an indicia indicating an end of a player turn corresponding to the at least one player, and a dealer turn corresponding to the dealer. Further, each of the remaining four sides of the playing dice comprise indicia corresponding to four numerical values. Further, the apparatus may include at least one player marker corresponding to the at least one player and the dealer. Further, the at least one player marker may include a movable piece including a marking for indicating the at least one player and the dealer. Further, the at least one player marker may be configured to be movable over the at least one score tracker. Further, the at least one player maker may be configured to be positioned over the at least one score tracker for indicating a score of the at least one player and the dealer.

Disclosed herein is an apparatus to play a casino game. Further, the apparatus may include table section. Further, the table section may include a player section including at least one player station and a depression may include a playing area. Further, at least one player may be positioned at the at least one player station while playing the casino game. Further, the casino game may be played on the playing area by the at least one player and a dealer representing a facility. Further, the table section may include a dealer section comprising a dealer station. Further, the dealer may be positioned at the dealer station while playing the casino game. Further, the dealer section may include at least one score tracker comprising a plurality of markings depicting a plurality of possible scores attained by the at least one player, and the dealer while playing the casino game. Further, the dealer section may include at least one player marker housing configured to store at least one player marker while the casino game may be not be played. Further, the apparatus may include a playing dice with six sides. Further, each of the 6 sides may include an indicia dispose thereupon. Further, two opposite sides of the playing dice comprise an indicia indicating an end of a player turn corresponding to the at least one player, and a dealer turn corresponding to the dealer. Further, each of the remaining four sides of the playing dice comprise indicia corresponding to four numerical values. Further, the apparatus may include at least one player marker corresponding to the at least one player and the dealer. Further, the at least one player marker may include a movable piece including a marking for indicating the at least one player and the dealer. Further, the at least one player marker may be configured to be movable over the at least one score tracker. Further, the at least one player maker may be configured to be positioned over the at least one score tracker for indicating a score of the at least one player and the dealer.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
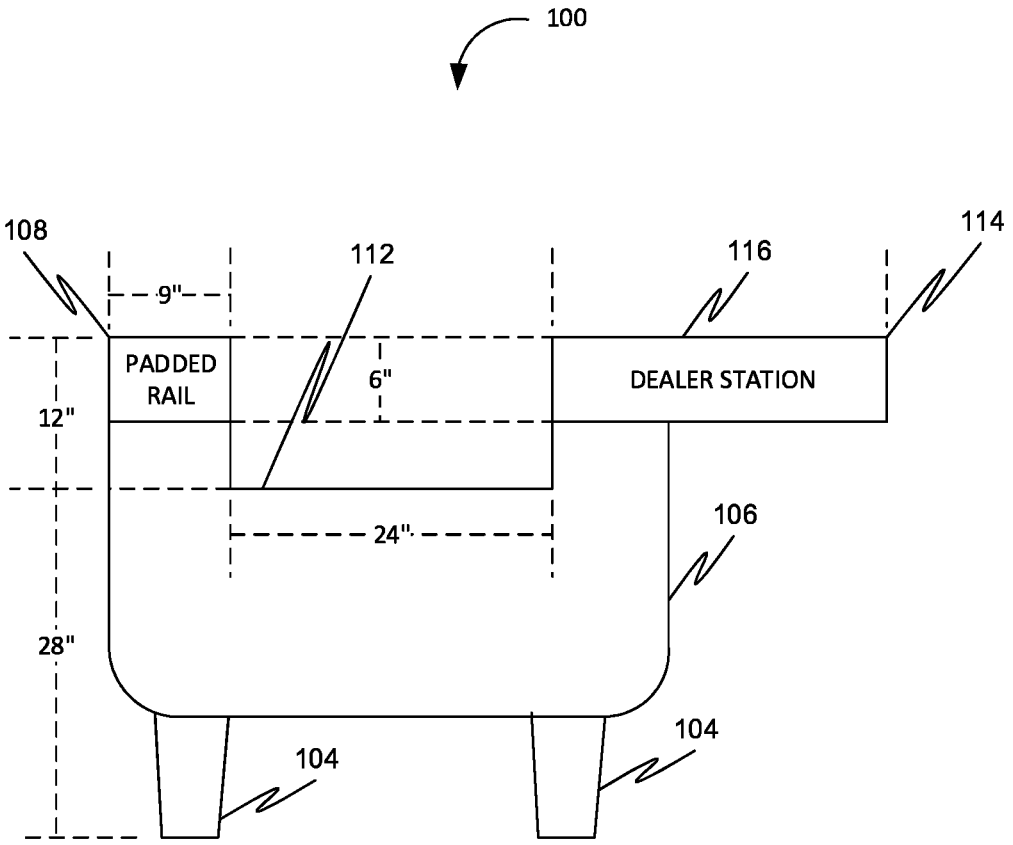
FIG. 1 is a side view of an apparatus to play a casino game, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of an apparatus to play a casino game, embodiments of the present disclosure are not limited to use only in this context.

Figure 2:
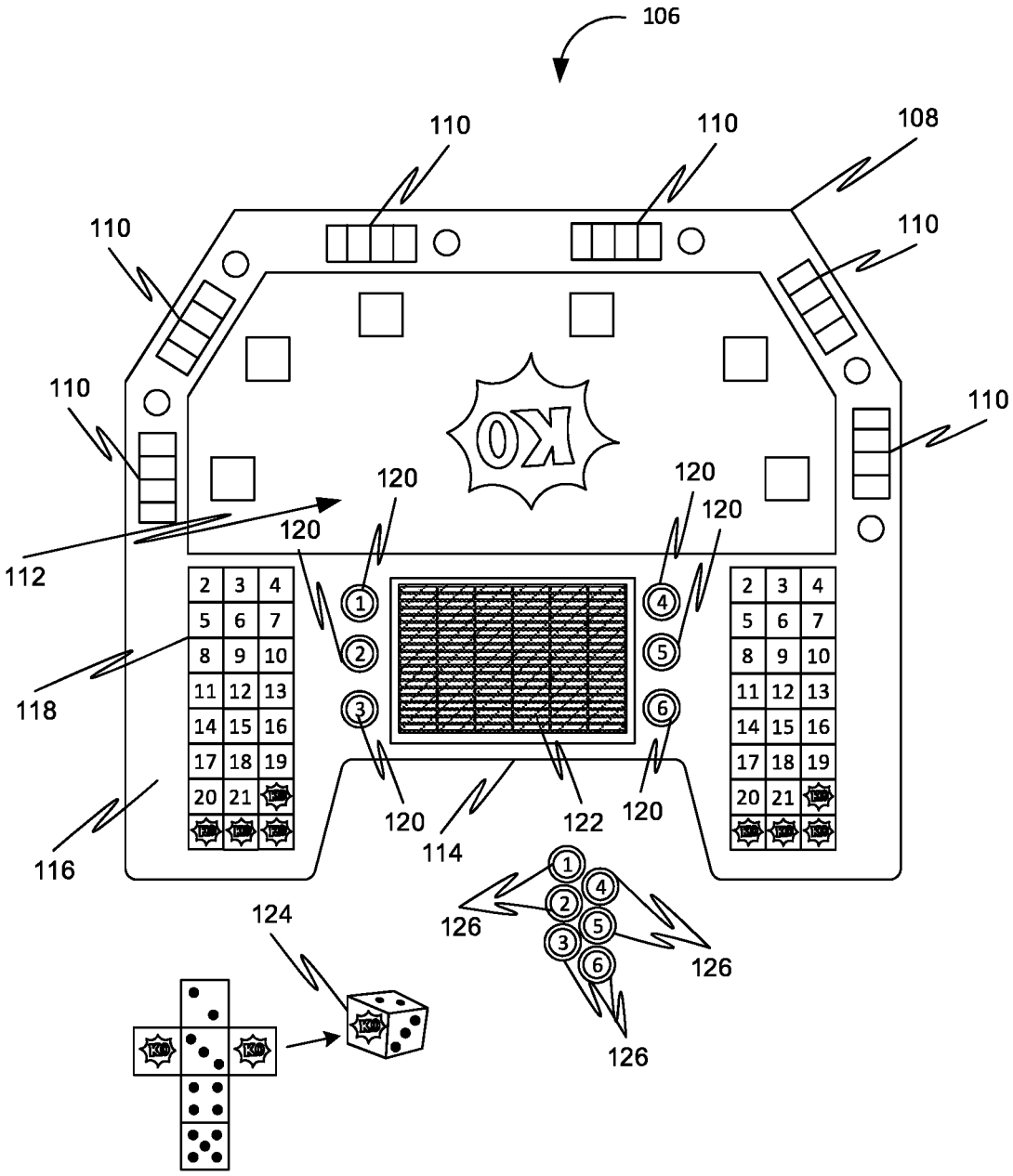
FIG. 2 is a top view of a table top of the apparatus, in accordance with some embodiments.
Figure 3:
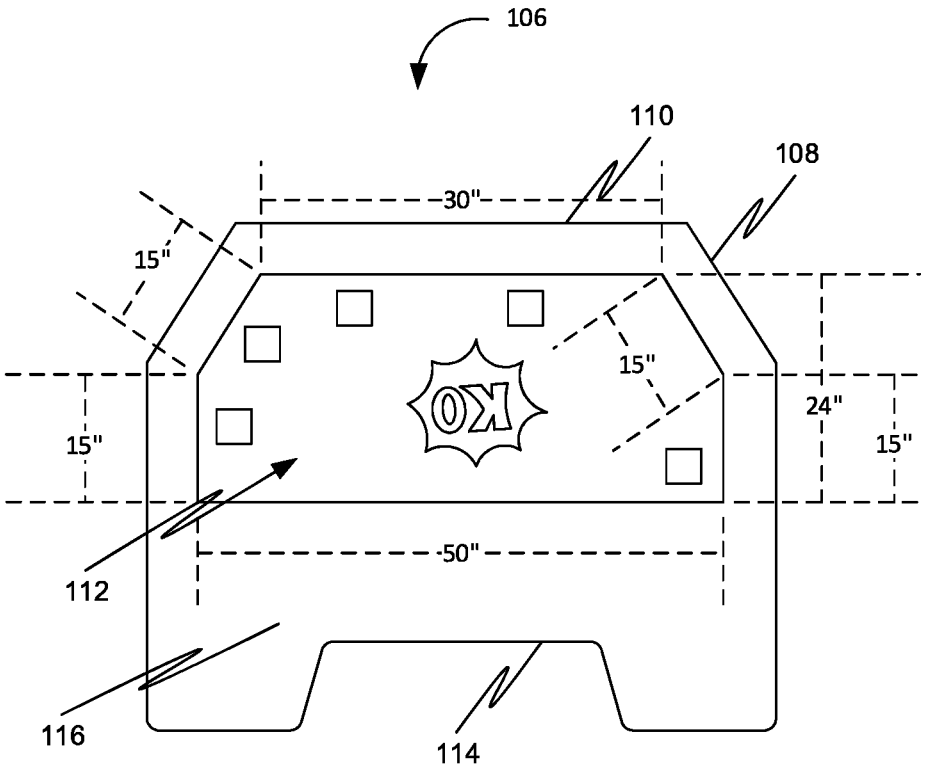
FIG. 3 is top view of the apparatus showing a plurality of dimensions of the table top, in accordance with some embodiments.

FIG. 1 is a side view of an apparatus 100 to play a casino game, in accordance with some embodiments. Further, FIG. 2 is a top view of a table top 106 of the apparatus 100 in accordance with some embodiments. Further, the apparatus 100 may include a plurality of legs 104 configured to support the table top 106. FIG. 1 also shows dimensions of some of the components of the apparatus 100 in accordance with an exemplary embodiment. FIG. 3 is top view of the apparatus 100 showing a plurality of dimensions of the table top 106, in accordance with some embodiments.

Further, the table top 106 may include a player section 108 including at least one player station 110 and a depression including a playing area 112. Further, at least one player may be positioned at the at least one player station 110 while playing the casino game. Further, the casino game may be played on the playing area 112 by the at least one player and a dealer representing a facility. Further, the table top 106 may include a dealer section 114 comprising a dealer station 116. Further, the dealer may be positioned at the dealer station 116 while playing the casino game. Further, the dealer section 114 may include at least one score tracker 118 comprising a plurality of markings depicting a plurality of possible scores attained by the at least one player, and the dealer while playing the casino game. Further, the dealer section 114 may include at least one player marker housing 120 configured to store at least one player marker 126 while the casino game is not in play. Further, the dealer section 114 may include a dealer chip housing 122 configured to store a plurality of casino chips of at least one denomination. Further, the plurality of casino chips may be used by the dealer to pay-off the at least one player based at least one pay-off rule of the casino game.

Further, the apparatus 100 may include a playing dice 124 with six sides. Further, each of the 6 sides may include an indicia dispose thereupon. Further, two opposite sides of the playing dice 124 comprise an indicia indicating an end of a player turn corresponding to the at least one player, and a dealer turn corresponding to the dealer. For instance, the indicia indicating the end of the player turn and the dealer turn may include "KO" (indicating "knockout").

Further, each of the remaining four sides of the playing dice 124 comprise indicia corresponding to four numerical values. Further, the apparatus 100 may include at least one player marker 126 corresponding to the at least one player and the dealer. Further, the at least one player marker 126 may include a movable piece including a marking for indicating the at least one player and the dealer. Further, the at least one player marker 126 may be configured to be movable over the at least one score tracker 118. Further, the at least one player maker 126 may be configured to be positioned over the at least one score tracker 118 for indicating a score of the at least one player and the dealer.

In alternate embodiments, the playing dice 124 is a multi-sided dice with "X" number of sides, where "X" is an integer. Further, each of the sides of the multi-sided dice may include an indicia dispose thereupon. Further, two opposite sides of the multi-sided dice may comprise an indicia indicating an end of a player turn corresponding to the at least one player, and a dealer turn corresponding to the dealer.

Further, the casino game may be initiated by the at least one player by laying down in the playing area 112 an ante bet in the form of at least one casino chip.

Further, the player turn may include the at least one player rolling the playing dice 124 at least once. Further, the dice must hit both the playing area 112 and surrounding wall to count. Further, a rolled score may be obtained by the at least one player based on at least one rolled numerical value. Further, the rolled score corresponding to the at least one roll by the at least one player may be added to obtain a total player score. Further, the at least one player may end the player turn upon realization of a desired total player score. Further, the total player score may be indicated by positioning at least one player marker 126 corresponding to the at least one player on the at least one score tracker 118.

For instance, the at least one player may roll "3", "2", and "5", on the playing dice 124, and the total player score may be "10", which may be reflected by the dealer on the score tracker 118 using the at least one player marker 126 corresponding to the at least one player.

Further, the player turn may end with a player loss along with a loss of the ante upon rolling the indicia indicating the end of the turn. For instance, if the at least one player rolls "4", "2", and "KO", the player turn may end, and dealer may reflect that the at least player may have been knocked out on the score tracker 118 using the at least one player marker 126 corresponding to the at least one player.

Further, the dealer turn may follow the player turn. Further, the dealer turn may include rolling of the game dice 124 at least once by the dealer. Further, a rolled score corresponding to the at least one roll by the dealer may be added to obtain a total dealer score. Further, the dealer turn may end upon the dealer score being more than or equal to the total player score, or the dealer rolling the indicia indicating the end of the turn. Further, the total player score may be indicated by positioning at least one player marker 126 corresponding to the dealer on the at least one score tracker 118. For instance, if the total score corresponding to the at least one player is "10", the dealer may roll the playing dice 124 to obtain a score of at least "10". Further, the dealer turn may end upon the dealer rolling a total dealer score of "11", or the dealer rolling the indicia indicating the end of the dealer turn, such as "KO".

Further, the at least one player may be determined to have won upon the dealer rolling the indicia indicating the end of the turn. Further, the at least one player may receive the pay-off from the dealer based on the at least one pay-off rule of the casino game in the form of at least one casino chip. For instance, the casino game may include a pay-off rule stating that the player may receive payoff in a ratio of 1:1, allowing the player to win an amount equal to the ante bet. For instance, if the player bets $100, and the dealer rolls "KO", the at least one player may receive the pay-off of $100 from the dealer.

Further, the at least one player may be determined to have lost upon the total dealer score being more than the total player score. Further, the at least one player may lose the ante bet. For instance, if the total player score is "10", and the total dealer score is "11", the at least one player may be determined to have lost, and may lose the ante bet.

Further, the casino game may be determined to be a tie if the dealer may end the dealer turn upon the total dealer score being equal to the total player score. Further, the at least one player retains the ante bet. For instance, if the total player score is "10", and the total dealer score is also "10", the casino game may be determined to be a tie, and the at least one player may retain the ante bet.

Further, the at least one player may attain a right to increase the ante bet to a double amount upon the total player score reaching a predetermined score. For instance, the predetermined score may be "13". Accordingly, the at least one player may attain a right to increase the ante bet to a double amount upon the total player score reaching "13"

Further, the at least one player may attain an automatic victory upon the total player score reaching a predetermined score. For instance, the predetermined score may be "21". Accordingly, the at least one player may attain a right to increase the ante bet to a double amount upon the total player score reaching "21".

Further, in an instance, the casino game may include a plurality of rules of play. For instance, while rolling the playing dice 124, the playing dice may need to bounce off at least once of at least one wall along the playing area of the table top 106.

Further, the playing area 112 may include a betting circle. Accordingly, the at least one player lays down an ante bet in the form of at least one casino chip in the betting circle. Further, the playing area 112 may include an additional betting circle. For example, the additional betting circle may be located at a distance of 2 inches from the betting circle. The additional betting circle may be used to place optional bets (or side bets). These side bets may be bets that are wagered against the very next roll. By placing this optional side bet, the at least one player bets that the very next roll is a "KO". For instance, 5 players may be playing at table top 106 of a table. Let's assume that the player 3 has just rolled 4 successful rolls (not a KO) and is going to roll a 5th time. Now, the rest of the players present at the table may lay a side bet that the very next roll (#5) will be a "KO". The payout for this side bet would be "x" times the placed bet. The players may not wager against themselves, so using the example above, the player 3 may not be able to lay a side bet against himself and his 5th roll.

Figure 4:
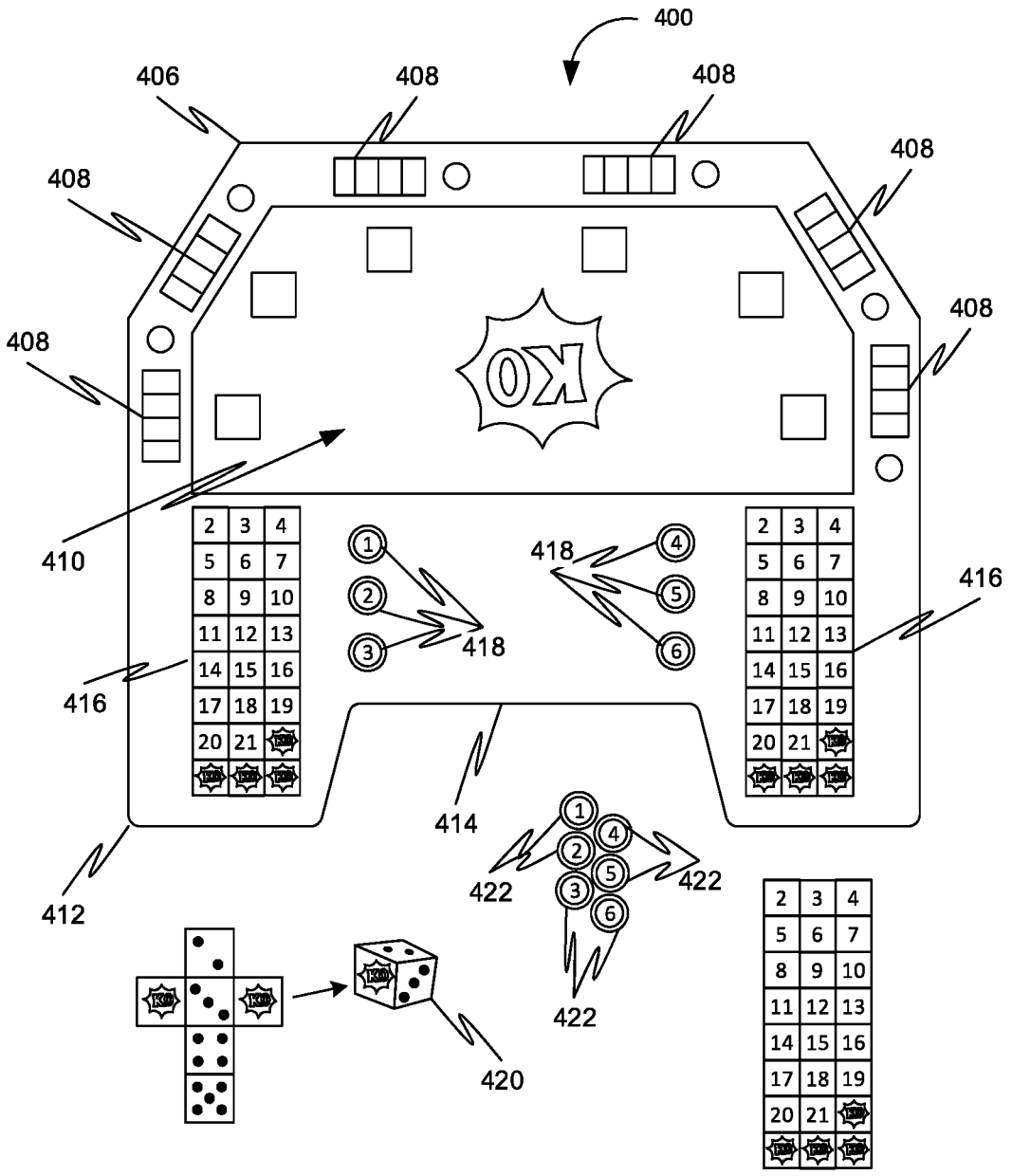
FIG. 4 is an apparatus to play a casino game, in accordance with some embodiments.

FIG. 4 is an apparatus 400 to play a casino game, in accordance with some embodiments. The apparatus 400 may be configured as a board game. Further, the apparatus 400 may include a top section 402 including a player section 406. Further, the player section 406 may include at least one player station 408 and a playing area 410. Further, at least one player may be positioned at the at least one player station 408 while playing the casino game. Further, the casino game may be played on the playing area 410 by the at least one player and a dealer representing a facility. Further, the top section 402 may include a dealer section 412. Further, the dealer section 412 may include a dealer station 414. Further, the dealer may be positioned at the dealer station 414 while playing the casino game. Further, the dealer section 412 may include at least one score tracker 416 which may include a plurality of markings depicting a plurality of possible scores attained by the at least one player, and the dealer while playing the casino game. Further, the dealer section 412 may include at least one player marker housing 418 configured to store at least one player marker 422 while the casino game may be not be played. Further, the dealer section 412 may include a playing dice 420 with six sides. Further, each of the 6 sides may include an indicia dispose thereupon. Further, two opposite sides of the playing dice 420 comprise an indicia indicating an end of a player turn corresponding to the at least one player, and a dealer turn corresponding to the dealer. Further, each of the remaining four sides of the playing dice 420 comprise indicia corresponding to four numerical values. Further, the dealer section 412 may include at least one player marker 422 corresponding to the at least one player and the dealer. Further, the at least one player marker 422 may include a movable piece including a marking for indicating the at least one player and the dealer. Further, the at least one player marker 422 may be configured to be movable over the at least one score tracker 416. Further, the at least one player maker may be configured to be positioned over the at least one score tracker 416 for indicating a score of the at least one player and the dealer.

Further, the casino game may be initiated by the at least one player by laying down an ante bet in the playing area 410.

Further, the at least one player turn may include the at least one player rolling the playing dice 420 at least once. Further, a rolled score may be obtained by the at least one player based on at least one rolled numerical value. Further, the rolled score corresponding to the at least one roll by the at least one player may be added to obtain total player score. Further, the at least one player may end the at least one player turn upon realization of a desired total player score. Further, the total player score may be indicated by positioning at least one player marker 422 corresponding to the at least one player on the at least one score tracker 416.

Further, the at least one player turn may end with a player loss along with a loss of the ante upon rolling the indicia indicating the end of the turn.

Further, the dealer turn may follow the at least one player turn. Further, the dealer turn may include rolling of the game dice 420 at least once by the dealer. Further, a rolled score corresponding to the at least one roll by the dealer may be added to obtain total dealer score. Further, the dealer turn may end upon the dealer score being more than or equal to the total player score, or the dealer rolling the indicia indicating the end of the turn. Further, the total player score may be indicated by positioning at least one player marker 422 corresponding to the dealer on the at least one score tracker 416.

Further, the at least one player may be determined to have won upon the dealer rolling the indicia indicating the end of the turn. Further, the at least one player receives the pay-off from the dealer based on the at least one pay-off rule of the casino game.

Further, the at least one player may be determined to have lost upon the total dealer score being more than the total player score. Further, the at least one player loses the ante bet.

Further, the casino game may be determined to be a tie if the dealer may end the dealer turn upon the total dealer score being equal to the total player score. Further, the at least one player retains the ante bet.

Further, each dealer roll and score is applicable to all players, since players are playing the dealer 1 on 1. For example, in a game the players may have following scores: Player 1-6 points, Player 2-10 points, Player 3-8 points, Player 4-17 points. Further, the dealer may have rolled the following four rolls: "5", "4", "2", "KO". Therefore, the dealer would have beaten players 1 and 3 upon his/her second roll of "4", which would have given him/her an accumulated score of 9 (5+4). The dealer would have then beaten player 2 after rolling his/her 3rd roll of "2", which would have made his/her accumulated score "11". Then the dealer would have lost to player 4 on his/her 4rth roll, as he/she would have rolled a "KO". In other words, the players are immediately eliminated once the dealer passes his/her score, and the dealer's "KO" only applies to players who have not been previously eliminated.

Further, the at least one player may attain a right to increase the ante bet to a double amount upon the total player score reaching a predetermined score.

Further, the at least one player may attain an automatic victory upon the total player score reaching a predetermined score.

Further, in some embodiments, the casino game may be played using an online platform, such as by acing the online platform through one or more electronic devices, including, but not limited to a tablet computer, a laptop computer, a desktop computer, a smartphone, a video game console, and so on.

A user of the one or more electronic devices, such as the one or more relevant parties, may access online platform through a web based software application or browser. The web based software application may be embodied as, for example, but not be limited to, a website, a web application, a desktop application, and a mobile application compatible with the electronic device.

Further, in an instance, the casino game may be embodied as a desktop application, a mobile application, and a video game compatible with the electronic device, allowing a user to play the casino game offline, such as with one or more users.

Further, in an instance, one or more figures described above, including the FIG. 1, the FIG. 2, the FIG. 3, and the FIG. 4 may represent a user interface of a system, a software application, and an online platform while facilitating playing the casino game to one or more players.

Although the present disclosure has been explained in relation to its preferred embodiment, it is to be understood that many other possible modifications and variations can be made without departing from the spirit and scope of the disclosure.

What is claimed is:

1. An apparatus to play a casino game, wherein the apparatus comprises;

a plurality of legs configured to support a table top; and the table top comprising:

a player section comprising at least one player station and a depression comprising a playing area, wherein at least one player is positioned at the at least one player station while playing the casino game, wherein the casino game is played on the playing area by the at least one player and a dealer representing a facility;

a dealer section comprising a dealer station, wherein the dealer is positioned at the dealer station while playing the casino game, wherein the dealer section further comprises:

at least one score tracker comprising a plurality of markings depicting a plurality of possible scores attained by the at least one player, and the dealer while playing the casino game;

at least one player marker housing configured to store at least one player marker while the casino game is not being played; and a dealer chip housing configured to store a plurality of casino chips of at least one denomination, wherein the plurality of casino chips is used by the dealer to pay-off the at least one player based at least one pay-off rule of the casino game; and at least one player marker corresponding to the at least one player and the dealer, wherein the at least one player marker comprises a movable piece including a marking for indicating the at least one player and the dealer, wherein the at least one player marker is configured to be movable over the at least one score tracker, wherein the at least one player maker is configured to be positioned over the at least one score tracker for indicating a score of the at least one player and the dealer; and a playing dice with six sides, wherein each of the six sides comprises an indicia dispose thereupon, wherein two opposite sides of the playing dice comprise an indicia indicating an end of a player turn corresponding to the at least one player, and a dealer turn corresponding to the dealer, wherein each of the remaining four sides of the playing dice comprise indicia corresponding to four numerical values.

2. The apparatus of claim 1 wherein the casino game is initiated by the at least one player by laying down in the playing area an ante bet in the form of at least one casino chip.

3. The apparatus of game of claim 2, wherein the player turn comprises the at least one player rolling the playing dice at least once, wherein a rolled score is obtained by the player based on at least one rolled numerical value, wherein the rolled score corresponding to the at least one roll by the at least one player is added to obtain a total player score, wherein the at least one player ends the player turn upon realization of a desired total player score, wherein the total player score is indicated by positioning at least one player marker corresponding to the at least one player on the at least one score tracker.

4. The apparatus of claim 3, wherein the player turn ends with a player loss along with a loss of the ante upon rolling the indicia indicating the end of the turn.

5. The apparatus of claim 3 wherein the dealer turn follows the player turn, wherein the dealer turn comprises rolling of the game dice at least once by the dealer, wherein a rolled score corresponding to the at least one roll by the dealer is added to obtain a total dealer score, wherein the dealer turn ends upon the dealer score being more than or equal to the total player score, or the dealer rolling the indicia indicating the end of the turn, wherein the total player score is indicated by positioning at least one player marker corresponding to the dealer on the at least one score tracker.

6. The apparatus of claim 5, wherein the player is determined to have won upon the dealer rolling the indicia indicating the end of the turn, wherein the at least one player receives the pay-off from the dealer based on the at least one pay-off rule of the casino game in the form of at least one casino chip.

7. The apparatus of claim 5, wherein the player is determined to have lost upon the total dealer score being more than the total player score, wherein the at least one player loses the ante bet.

8. The apparatus of claim 5, wherein the casino game is determined to be a tie if the dealer ends the dealer turn upon the total dealer score being equal to the total player score, wherein the player retains the ante bet.

9. The apparatus of claim 3, wherein the at least one player attains a right to increase the ante bet to a double amount upon the total player score reaching a predetermined score.

10. The apparatus of claim 3, wherein the at least one player attains an automatic victory upon the total player score reaching a predetermined score.

11. An apparatus to play a casino game, wherein the apparatus comprises;

a top section and a playing dice, wherein the top section comprising;

a player section comprising at least one player station and a depression comprising a playing area, wherein at least one player is positioned at the at least one player station while playing the casino game, wherein the casino game is played on the playing area by the at least one player and a dealer representing a facility; and a dealer section comprising a dealer station, wherein the dealer is positioned at the dealer station while playing the casino game, wherein the dealer section further comprises:

at least one score tracker comprising a plurality of markings depicting a plurality of possible scores attained by the at least one player, and the dealer while playing the casino game; and at least one player marker housing configured to store at least one player marker while the casino game is not being played;

at least one player marker corresponding to the at least one player and the dealer, wherein the at least one player marker comprises a movable piece including a marking for indicating the at least one player and the dealer, wherein the at least one player marker is configured to be movable over the at least one score tracker, wherein the at least one player maker is configured to be positioned over the at least one score tracker for indicating a score of the at least one player and the dealer;

the playing dice comprising six sides, wherein each of the 6 sides comprises an indicia dispose thereupon, wherein two opposite sides of the playing dice comprise an indicia indicating an end of a player turn corresponding to the at least one player, and a dealer turn corresponding to the dealer, wherein each of the remaining four sides of the playing dice comprise indicia corresponding to four numerical values.

12. The apparatus of claim 11 wherein the casino game is initiated by the at least one player by laying down an ante bet in the playing area.

13. The apparatus of game of claim 12, wherein the player turn comprises the at least one player rolling the playing dice at least once, wherein a rolled score is obtained by the player based on at least one rolled numerical value, wherein the rolled score corresponding to the at least one roll by the at least one player is added to obtain total player score, wherein the at least one player ends the player turn upon realization of a desired total player score, wherein the total player score is indicated by positioning at least one player marker corresponding to the at least one player on the at least one score tracker.

14. The apparatus of claim 13, wherein the player turn ends with a player loss along with a loss of the ante upon rolling the indicia indicating the end of the turn.

15. The apparatus of claim 13 wherein the dealer turn follows the player turn, wherein the dealer turn comprises rolling of the game dice at least once by the dealer, wherein a rolled score corresponding to the at least one roll by the dealer is added to obtain total dealer score, wherein the dealer turn ends upon the dealer score being more than or equal to the total player score, or the dealer rolling the indicia indicating the end of the turn, wherein the total player score is indicated by positioning at least one player marker corresponding to the dealer on the at least one score tracker.

16. The apparatus of claim 15, wherein the player is determined to have won upon the dealer rolling the indicia indicating the end of the turn, wherein the at least one player receives the pay-off from the dealer based on the at least one pay-off rule of the casino game.

17. The apparatus of claim 15, wherein the player is determined to have lost upon the total dealer score being more than the total player score, wherein the at least one player loses the ante bet.

18. The apparatus of claim 15, wherein the casino game is determined to be a tie if the dealer ends the dealer turn upon the total dealer score being equal to the total player score, wherein the player retains the ante bet.

19. The apparatus of claim 13, wherein the at least one player attains a right to increase the ante bet to a double amount upon the total player score reaching a predetermined score.

20. The apparatus of claim 13, wherein the at least one player attains an automatic victory upon the total player score reaching a predetermined score.

* * * * *